US011358272B2

(12) United States Patent
Bühl et al.

(10) Patent No.: US 11,358,272 B2
(45) Date of Patent: Jun. 14, 2022

(54) RETAIL PACKAGING AND TRANSPORT BOX FOR SMALL PARTS, TOOLS, MACHINES OR SUCH OBJECTS

(71) Applicant: ROTHENBERGER AG, Kelkheim (DE)

(72) Inventors: Thorsten Bühl, Wiesbaden (DE); Suzanna Henkel, Liederbach (DE)

(73) Assignee: ROTHENBERGER AG, Kelkheim (DE)

( * ) Notice: Subject to any disclaimer, the term of this patent is extended or adjusted under 35 U.S.C. 154(b) by 83 days.

(21) Appl. No.: 16/492,568

(22) PCT Filed: Mar. 6, 2018

(86) PCT No.: PCT/DE2018/100200

§ 371 (c)(1),
(2) Date: Sep. 9, 2019

(87) PCT Pub. No.: WO2018/166560

PCT Pub. Date: Sep. 20, 2018

(65) Prior Publication Data

US 2020/0039057 A1 Feb. 6, 2020

(30) Foreign Application Priority Data

Mar. 13, 2017 (DE) ..... 10 2017 105 313.1

(51) Int. Cl.
*B25H 3/02* (2006.01)

(52) U.S. Cl.
CPC ..... *B25H 3/023* (2013.01)

(58) Field of Classification Search
CPC . B25H 3/023; B65D 1/22; B65D 1/24; B65D 1/34; B65D 1/36; B65D 5/001; B65D 5/005; B65D 21/00; B65D 21/02; B65D 21/0209; B65D 21/0224; B65D 21/0226; B65D 21/023; B65D 21/0223
(Continued)

(56) References Cited

U.S. PATENT DOCUMENTS 5,102,021 A * 4/1992 Perea ..... B62J 9/40 224/440
5,439,108 A * 8/1995 Lackie ..... B25H 3/023 206/373
(Continued)

FOREIGN PATENT DOCUMENTS

DE 6949728 U 7/1970
DE 29712619 U1 11/1997
(Continued)

*Primary Examiner* — King M Chu
(74) *Attorney, Agent, or Firm* — Smartpat PLC

(57) ABSTRACT

A box for transporting and/or storing small parts, tools, machines or such objects comprises a body, a lid and a receiving space formed by the body and the lid. The body has a bottom and side walls surrounding the bottom. The lid is connected to the body. The receiving space contains at least one storage container for small parts, tools, machines or such objects. The receiving space comprises a flat section facing the storage container on one side thereof and a grid formed by a plurality of protrusions. The storage container is arranged on the flat section, in a position that secures against lateral movement, using at least one, preferably a plurality of the protrusions.

20 Claims, 4 Drawing Sheets

(58) Field of Classification Search
USPC ..... 206/372
See application file for complete search history.

(56) References Cited

U.S. PATENT DOCUMENTS

| | | | | |
|---|---|---|---|---|
| 6,343,708 | B1 * | 2/2002 | Riso | B25H 3/02 206/373 |
| 6,401,300 | B1 | 6/2002 | Korn et al. | |
| 2002/0027403 | A1 | 3/2002 | Vasudeva | |
| 2006/0070900 | A1 * | 4/2006 | Brunson | B25H 3/003 206/373 |
| 2006/0131472 | A1 | 6/2006 | Lee | |
| 2006/0249522 | A1 * | 11/2006 | Ringo | B65D 45/20 220/784 |
| 2007/0272572 | A1 | 11/2007 | Chen | |
| 2012/0111750 | A1 | 5/2012 | Phillips | |
| 2014/0340034 | A1 | 11/2014 | Dietzel et al. | |

FOREIGN PATENT DOCUMENTS

| | | | | |
|---|---|---|---|---|
| DE | 19641686 | A1 * | 4/1998 | B65D 21/0209 |
| DE | 102005020271 | A1 | 12/2005 | |
| DE | 202015100103 | U1 * | 2/2015 | B25H 3/02 |
| DE | 202015100103 | U1 | 2/2015 | |
| EP | 2308655 | A2 * | 4/2011 | B25H 3/022 |
| GB | 2382811 | * | 6/2003 | |
| GB | 2482126 | A | 1/2012 | |
| WO | 2016177509 | A1 | 11/2016 | |

* cited by examiner

RETAIL PACKAGING AND TRANSPORT BOX FOR SMALL PARTS, TOOLS, MACHINES OR SUCH OBJECTS

TECHNICAL FIELD

The disclosure concerns retail packaging for small parts, tools, machines or other objects. The disclosure concerns, moreover, a box for transporting and/or storing small parts, tools, machines or other objects.

BACKGROUND

Goods such as, for example, tools, spare parts for tools and tool accessories are often sold in retail packaging in order to protect the goods on the way from the dealer to the end user. Once purchased the retail packaging has in most instances no further function and is discarded. In some instances the goods are left in the retail packaging, which then serves to store them.

With tradesmen it is a common occurrence to use a so-called tool box. It often contains machines and small parts to make transport to the building site easier. These objects would otherwise have to be transported individually. These objects are often arbitrarily placed into the tool box so that, due to the multitude and variety of objects with different dimensions there is a high degree of clutter in the tool box. Therefore the use of the retail packaging as a storage container is often limited due to the available space.

SUMMARY

It is an object of the disclosure to propose at least a cost-effective possibility of a box for the transport and/or storage of small parts, tools, machines or other objects in which as many objects as possible can be stored in an orderly fashion.

Basic retail packaging for small parts, tools, including spares for tools and/or tool accessories, as well as for machines or other objects includes an inherently stable, in particular rigid container for housing an object and is in particular suitable as storage container in an organising system. Moreover, the retail packaging comprises a material section with a supporting element, wherein said material section extends away from the container to the outside in an initial position so that the supporting element can be used to attach the retail packaging to a product display device such as, for example, a product display wall. Moreover, the retail packaging comprises a connecting device that connects the material section with the container, which is designed to bring out the material section from the initial position so as to reduce the size or the dimensions of the retail packaging respectively.

Retail packaging of this kind lends itself for application in an organising system to be used as storage container for objects. The retail packaging facilitates high-density packaging in the organising system. To this end provision is made that the material section, which is significant for the product presentation in the sales process, can be removed from its outward-pointing position. This allows the product packaging to be transformed into a more compact size. This achieves simultaneously a cost advantage since the retail packaging, which already exists as a result of purchasing the product, can now also be used as a storage container.

The supporting element may be a cut-out. The supporting element is formed, for example, as a Euro hole, which is provided in the material section. The material section may be inherently stable or flexible. Using the cut-out, the retail packaging may be suspended, for example, on a wall hook of a perforated wall for presentation purposes.

According to one embodiment the connecting device is designed as a hinge through which the material section is pivotable with respect to the container from the initial position into a storage position, in which the material section is folded away into the vicinity of a wall section of the container, in particular close to the wall section, for example in the immediate vicinity of the wall section. If required, this permits the material section to be moved to fulfil a function where the retail packaging is suspended, for example on a product display device. To that end the material section need only to be pivoted from its storage position into the initial position. Thus the supporting function of the material section may be restored again for a product presentation, for example.

It is expedient for the wall to be provided with a recess or pocket or similar in which the material section is located in the storage position. This prevents the material section from extending forward beyond the wall in the storage position, which would increase the dimension of the container unnecessarily.

Moreover it is expedient for the retail packaging to be a plastic moulding. To this end the retail packaging may consist of plastic or contain plastic. It is furthermore expedient for the hinge to be a film hinge. This makes the retail packaging easier to produce from a technical point of view.

A locking element may be provided through which the material section may be locked against the container in the storage position. This retains the material section in the storage position and is only able to be retrieved from the storage position after exerting a predetermined force that overcomes the locking force. The locking element may be a latching element, for example a catch. The locking element may be manufactured in a technically simple manner if it is disposed on the wall of the container, in particular if it is moulded to the wall.

According to a further embodiment or a different embodiment the connecting device is provided with at least one predetermined breaking point at which the material section can be separated from the container under application of a separating force. In this technically simple manner it is possible to transform the retail packaging into a compact storage container for small parts, tools, machines or other objects. The predetermined breaking point may be achieved through one or more tapered sections on the connecting device between the material section and the container. Such tapered sections may also be provided on the above-described hinge in order to provide, for example, in addition to being able to pivot the material section the option of separating it from the retail packaging.

It is expedient to provide the container of the retail packaging with a base body that has a fill opening, which may be closed at least partially by a lid part. The lid part may be attached to the base body by one or more positive-locking elements, which are provided on the base body and/or on the lid part. The positive-locking elements may be latching elements such as, for example, clip elements or similar. It is, moreover, expedient that the lid part is made from a transparent material, or incorporates a transparent material, so that at least the contours of the objects contained in the retail packaging are visible from the outside.

A basic box for transporting and/or storing small parts, tools including spare parts for tools and/or tool accessories as well as machines or other objects comprises a body, a lid that is attached or may be attached to the body, and a receiving space formed by the body and the lid. The body itself comprises a bottom and a side wall surrounding the bottom. The body is, for example, made to be inherently stable, in particular rigid. In addition the lid may also be made to be inherently stable, in particular rigid. Nevertheless, the lid may essentially be flexible as well. The body, for example, is formed by a first shell and the lid by a second shell. With the box particular provision is made that, in a closed state, the receiving space between the body and the lid is inaccessible, in particular from the outside or externally. This means in particular that the receiving space is shut off in a closed state. Moreover, provision is made in particular that in an open state between the body and the lid the receiving space is accessible, that is, accessible in particular from outside. This means in particular that the receiving space is open or is in an opened state respectively.

Disposed or disposable in the receiving space of the box is at least one storage container for small parts, tools, including spare parts for tools and/or tool accessories as well as machines or other objects. Moreover, an insert may be placed inside, which faces the storage container with a front side. The insert is provided at its front side with a grid, in particular a regular grid, which is created by a plurality of protrusions, and the storage container may be placed in a fixed position relative to the insert by utilising one, preferably multiple, protrusions of the insert, preferably through an exactly-fitting engagement, for example in that the storage container will be positioned, or is positioned, on the insert with at least one, preferably with multiple wall sections.

A box of this kind forms together with the insert and the at least one storage container an organising system. Due to the at least one storage container a space inside the box may be assigned to an object to be stored in that the container is pressed into the exactly-fitting protrusions in an arbitrary location on the insert. Relative to the insert the storage container is thus located in a fixed position and/or secured against lateral displacement. Further storage containers can be positioned in the same manner, which may also be disposed inside the receiving space of the box. Due to the separate insert it is possible to retrofit the organising system in commonly used box systems. To this end the insert only needs to be placed inside the receiving space of the respective box or box system.

In particular at least one storage container for small parts, tools, including spare parts for tools and/or tool accessories as well as for machines or other objects is received or may be received into the receiving space, and in particular the receiving space is provided with a surface area, which with one side, for example an upper side, faces the storage container and is provided with a grid that is formed by a plurality of protrusions. In particular the storage container is disposed on the surface area by utilising at least one, preferably multiple of the protrusions in a position secured against lateral displacement. The protrusions and the grid may be the above-described protrusions and the above-described grid. To that extent the above-described effects and/or advantages are caused by the protrusions and the grid.

In particular the surface area may be formed on the bottom of the body, for example it may be moulded with it. It is essentially possible to form the surface area also on the lid, for example it may be moulded with it. Alternatively, the surface area may be formed on an insert, in particular it may be moulded with it. The insert is, for example, placed into the receiving space and in particular faces the storage container with a front side.

The protrusions are, for example, angular in cross-section, in particular polygonal, for example square or rectangular. For example adjacently located protrusions are distanced or separated from each other respectively by at least one space. In particular, the wall sections of the storage container engage with individual spaces, for example in that the wall sections are formed by protruding edge sections of the storage container.

According to one embodiment provision is made that the insert is braced with its back side against the bottom of the body, in particular is braced directly against the bottom of the body. Thus the insert lies against a defined area of the box. To prevent the insert from falling out of the box, the insert may be fixed to the bottom, for example it may be attached to the bottom with and adhesive coating. Nevertheless, the insert may also simply sit loose on the bottom.

In order to secure the insert relative to the box it may also be provided that the insert is secured between the side walls of the body against lateral displacement. This option is particularly viable if the insert has been placed loosely into the body of the box. To this end the insert is provided, for example, with a dimension in at least one spatial axis that corresponds to the inside clearance of the side walls of the body in the direction of the at least one spatial axis so that the insert is seated in the receiving space of the body at least in the direction of the one spatial axis with little play.

Moreover, the insert may be placed with a tight fit between the side walls of the body. Thus the insert is located largely or completely displacement-proof relative to the bottom of the body. The inside clearance of the side walls is understood to be the distance between each other opposing side walls, which is to be covered by the dimension of the insert to largely or fully avoid a lateral displacement of the insert between the each other opposing walls.

It is expedient to make the insert tub-shaped and to form the protrusions on a bottom of the insert. This allows the insert to be retrieved in a simple manner from the body of the box. To this end recesses may be provided in the side walls of the tub-shaped insert that may be used as handhold. This also makes it easier to retrieve the insert from the receiving space of the body. Nevertheless, the insert may essentially also be plate-shaped.

According to another embodiment the insert is braced with its back side against further storage containers, in particular directly against further storage containers which, whilst forming a first layer, are braced against the bottom of the body so that the at least one storage container disposed on the insert forms a second layer. This may achieve a higher degree of order since the storage containers are disposed on two levels. This also permits the storage of multiple different objects in the box in an orderly manner since the two levels allow a greater number of storage containers to be stored in the box.

In order to secure the first layer relative to the box, provision may be made that the first layer, formed by the further storage containers, is secured between the side walls of the body against lateral displacement.

To this end the first layer with the further storage containers has, for example, a dimension in at least one spatial axis that corresponds to the inside clearance of the side walls of the body in the direction of the at least one spatial axis so that the first layer is retained with minimal play inside the receiving space of the body at least in the direction of the one spatial axis. This largely or completely avoids a lateral displacement of the further storage containers on the bottom of the body. The storage containers may be stored together as a group, positionally stable between the side walls.

According to a different embodiment again, the insert is braced with its back side against further storage containers, in particular directly against further storage containers which, whilst forming a first layer, are braced, in particular braced with a tight fit, against a further insert that is provided with grid-like protrusions, so that the at least one storage container positioned on the insert forms a second layer. Thus two inserts are provided of which on the one insert the further storage containers of the first layer are positioned and on the other insert the storage containers of the second layer are positioned. It is expedient that the further insert is braced with its back side against the bottom of the body, in particular directly against the body of the bottom.

In order to secure the further insert relative to the box, provision may be made to secure the further insert between the side walls of the body against lateral displacement. This is particularly the case when the insert is placed loosely into the body of the box. To this end the further insert is dimensioned, for example, in the direction of at least one spatial axis that corresponds to the inside clearance of the side wall of the body in the direction of the at least one spatial axis so that the further insert is disposed into the receiving space of the body at least in the direction of the one spatial axis with minimum play. This largely or completely avoids a lateral displacement of the further insert between the side walls.

For example the insert is formed tub-shaped and the further insert is plate-shaped. Due to the tub-shape the retrieval of the insert from the receiving space of the body is made easy since the insert can be gripped on the side walls, for example when the side walls protrude above the body.

It is expedient that the protrusions of the insert and the protrusions of the further insert are essentially one above the other and in line to each other in the direction from the bottom of the body to the lid in the closed position of the box. This ensures that the first layer and the second layer may be positioned one above the other without lateral offset to each other.

Due to the lid of the box it is possible to secure the at least one storage container against disengagement from the insert in a simple manner. Depending on whether one insert or multiple inserts are provided, or whether the storage containers are arranged in a single layer or plane respectively or in multiple layers or planes respectively, different embodiments are provided for.

Provided that the above-described one insert and the above-described at least one storage container are provided exclusively, it is expedient that, in the closed position, the receiving space of the box has an inside height clearance that corresponds with, in particular corresponds essentially with, the external height of the at least one storage container plus the thickness of the insert but without the height of the protrusions, so that in the closed position the storage container is secured against disengagement from the protrusions of the insert.

In the instance that two planes with storage containers are provided but only a single insert, it is expedient that, in the closed position, the receiving space of the box has an inside height clearance that corresponds with, in particular corresponds essentially with, the external height of the first layer with the at least one storage container plus the thickness of the insert but without the height of the protrusions, so that in the closed position the storage container is secured against disengagement from the protrusions of the insert.

In the instance that the two above-described layers are provided with the further storage containers and the at least one storage container is provided and in addition the two above-described inserts are provided, it is expedient that, in the closed position, the receiving space of the box has an inside height clearance that corresponds with, in particular corresponds essentially with, the external height of the first layer with the further storage containers and the second layer with the at least one storage container plus the thickness of the insert and the thickness of the further insert but without the height of the protrusions, so that in the closed position the storage containers are secured against disengagement from the protrusions of the insert. The inside height clearance is in particular understood to be the distance in space direction from the bottom of the body to the cover in the closed position of the box.

It is expedient that the at least one storage container and the at least one insert, or the multiple layers with storage containers and the multiple inserts respectively, which are disposed inside the receiving space of the box, are in the closed state of the box pressed against each other between the cover and the bottom of the box. To that end the inside of the lid may be provided with an elastic, in particular resilient, intermediary layer, so that in the closed state of the box a compression force derived from the deformation of the intermediary layer acts on the at least one storage container and/or the further storage containers. The intermediary layer may be provided in form of a mat. The intermediary layer consists, for example, of a foam material, or contains a foam material. In particular the intermediary layer is made from a foam mat.

According to a further embodiment provision is made that the at least one storage container is provided on one side, in particular on its upper side, with an at least partially upwards protruding edge for stacking, in particular for tightly-fitting stacking, of a further storage container. Thus the storage container can be stacked in a technically simple manner with the further container or the further containers. The above-described retail packaging may be shaped in the same manner so that a stacking of such retail packages is also possible.

The at least one storage container and/or the above-described further storage containers described in conjunction with the box may form retail packaging as already described above.

According to a further aspect an application of said retail packaging, for example the above-described retail packaging, is that of a storage container in an organising system. The organising system may comprise the above-described box, wherein the at least one storage container of the box, or the further storage container respectively, are formed by the retail packaging.

BRIEF DESCRIPTION OF THE DRAWINGS

Further details and characteristics become apparent from the following description of at least one exemplary embodiment by way of a drawing.

DETAILED DESCRIPTION

Figure 1:
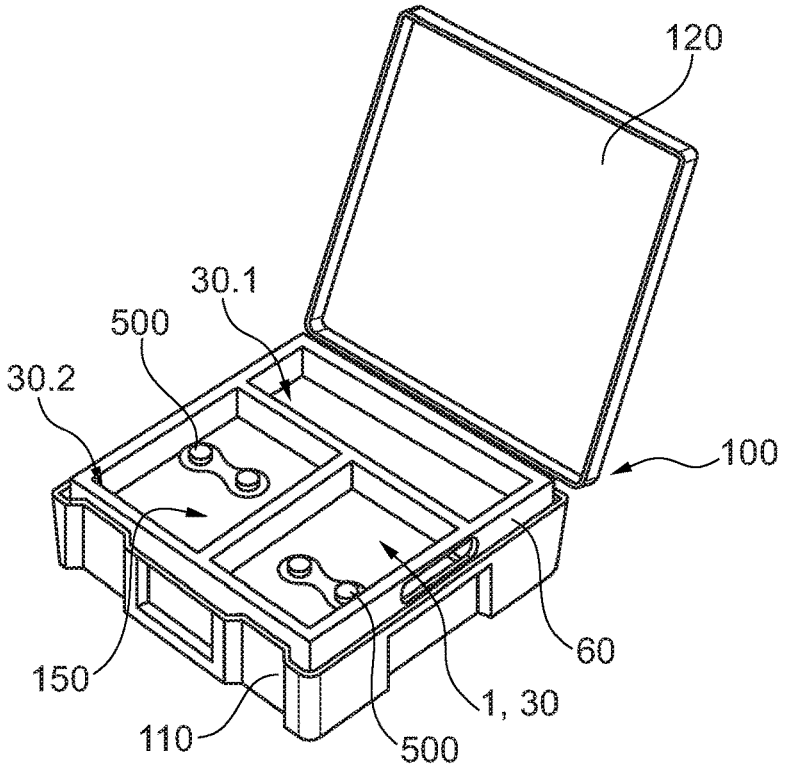
FIG. 1 shows one possible embodiment of a box for transporting and/or storing of small parts, tools, machines or other objects in perspective view.

FIG. 1 shows, in schematic representation, one possible embodiment of a box for transporting and/or storing of small parts, tools, spare parts for tools, tool accessories, machines and/or other objects. The box 100 consists of a body 110 and a lid 120, which is attached or may be attached to the body 110. The body 110 is preferably made to be rigid. The lid 120 is preferably also rigid in construction.

For example the body 110 and the lid 120 are attached in a pivotable manner to each other. The body 110 and the lid 120 may be brought into a closed state or into an open state with respect to each other. In the closed state the body 110 and the lid 120 form a receiving space 150, which is inaccessible in particular from the outside. Nevertheless, in the open state the receiving space 150 is accessible from the outside. In FIG. 1 the box 100 is in the open state.

Multiple storage containers 30, 30.1, 30.2 are disposed inside the receiving space 150. The storage containers 30, 30.1, 30.2 are each suitable to hold small parts, tools, spare parts for tools, tool accessories, machines or other objects. For example an object 500 each is allocated to storage containers 30, 30.2 and stored therein.

Figure 2:
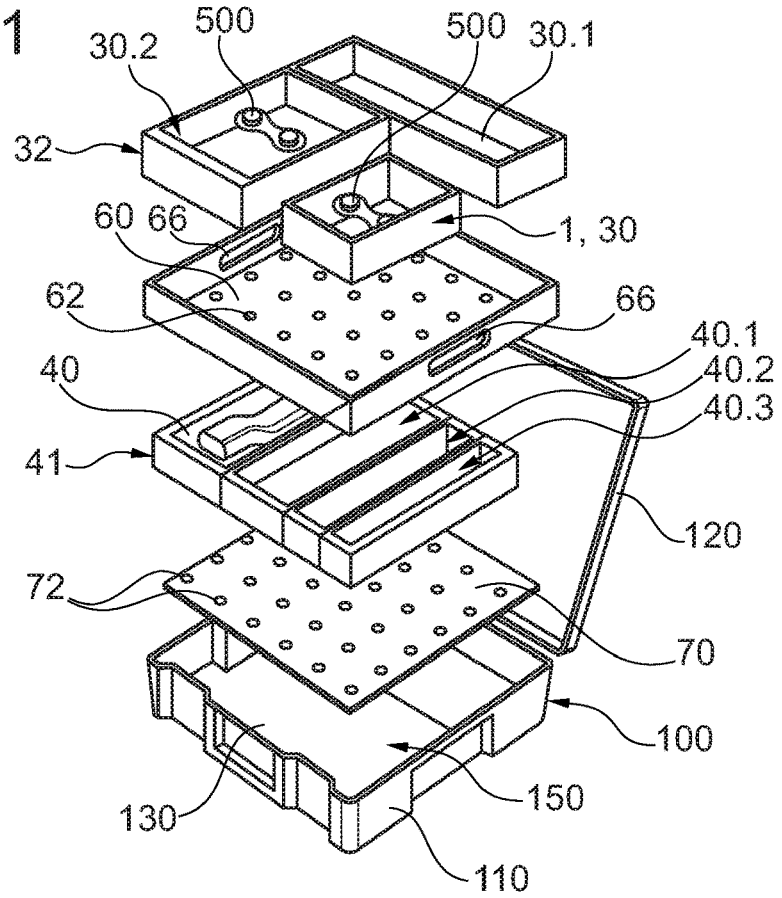
FIG. 2 shows the box of FIG. 1 with its components in exploded view.

FIG. 2 shows the box with its content in an exploded view. It is apparent from this that further storage containers 40, 40.1, 40.2 and 40.3, which form a first layer 41, are provided below the storage containers 30, 30.1, 30.2. The storage containers 30, 30.1, 30.2 disposed above form a second layer 32. An insert 60 is provided between the first layer 41 and the second layer 32. Moreover, a further insert 70 is provided between the first layer 41 and the bottom 130 of body 110.

The insert 60 and/or the further insert 70 are preferably made to be flat. For example the insert 60 and/or the further insert 70 are inherently stable. Alternatively, the insert 60 and/or the further insert 70 may be made to be flexible. The insert 60 and/or the further insert 70 are produced, for example, as plastic mouldings.

Figure 3:
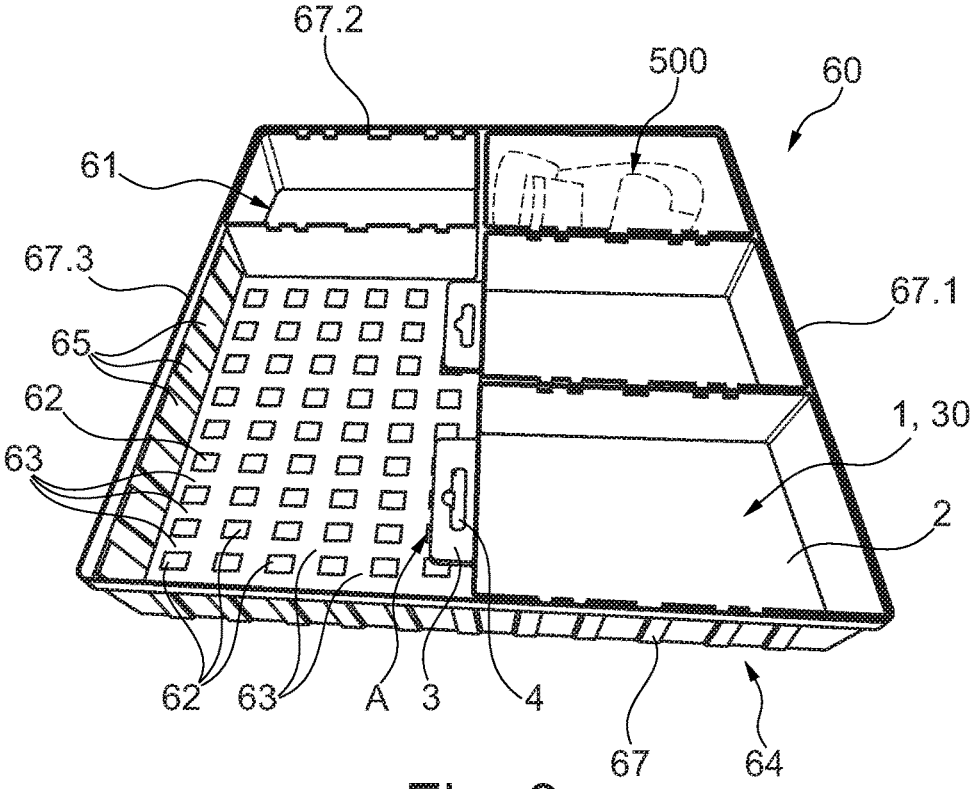
FIG. 3 shows one possible embodiment of an insert with storage containers disposed thereon, which together can be inserted into the box of FIGS. 1 and 2, in perspective view.

As an example, FIG. 3 depicts the insert 60 with the storage container 30. The insert 60 has a front side 61 and a back side 64. The insert 60 faces with its front side 61 the storage container 30. The insert 60 is provided at its front side 61 with a plurality of protrusions 62, which form a regular grid or pattern respectively. The protrusions 62 facilitate a positive-locking connection between the insert 60 and, for example, the storage container 30. Through utilising at least one, preferably multiple of the protrusions 62 through a tightly-fitting engagement with at least one, preferably multiple wall sections 31, 31.1, 31.2, 31.3 (cf. FIG. 7) of the storage container 30, the storage container 30 is positioned on the insert 60.

In other words, due to the grid, which is the result of the protrusions 62, positioning of the storage container 30 in an arbitrary position on the insert 60 is possible. To that end the wall sections 31, 31.1, 31.2, 31.3 of the storage container 30 are formed such that they engage with individual or multiple protrusions 62 and thus avoid, or at least avoid to a large degree, a lateral displacement of the storage container 30 with respect to the insert 60.

The protrusions 62 are preferably arranged in rows, wherein a space 63 is provided between adjacent rows of protrusions 62. Protrusions 62 are also arranged in rows, preferably transverse to the longitudinal direction of the rows, and a space 63 each is provided between adjacent rows. The protrusions 62 are preferably polygonal in cross-section, in particular square or rectangular.

It is preferred that the further insert 70 is also provided with a plurality of protrusions 72 (cf. FIG. 2), which form a regular grid or pattern. As is apparent from FIG. 2, for example, the storage containers 40, 40.1 and 40.2 are positioned on the further insert 70 whilst utilising at least one, preferably multiple of the protrusions 62 through a tightly-fitting engagement against at least one, preferably multiple wall sections of the storage containers 40, 40.1 and 40.2, and are in this manner secured against lateral displacement along the further insert 70.

The insert 60, which is disposed at the top with respect to the further insert 70, is preferably made tub-shaped. The insert 60 is preferably provided with side walls 67, 67.1, 67.2, 67.3, each of which is provided with at least one, preferably multiple reinforcement structures, such as corrugations 65, for example. The insert 60 may, for example, be provided on opposite side walls with a cut-out 66 that forms a handhold to be able to lift the insert 60 out of the receiving space 150.

To position the insert 60 with as little play as possible in the receiving space 150, the insert 60 is provided with such dimensions between opposing side walls 140 and 140.2 as well as 140.1 and 140.3 so that the insert 60 fits between them without significant play. The further insert 70 is preferably braced with its back side directly against the bottom 130 of the body 110. It is preferable that the further insert 70 is provided with dimensions in the direction between the side walls 140, 140.1, 140.2 and 140.3 of the body 110 in such a way that the further insert 70 is retained between them without significant play, or largely without play, which avoids a lateral displacement of the further insert 70 relative to the bottom 130 of the body 110.

It is preferred that the external dimensions of the insert 60 and the external dimensions of the further insert 70 correspond to each other. It is further preferred that the arrangement of the protrusions 62 to each other and relative to the insert 60, and the protrusions 72 to each other and relative to the further insert 70, correspond to each other so that in the inserted state of the insert 60 and the further insert 70 the protrusions 62 and the protrusions 72 are essentially aligned, which avoids a lateral displacement of the storage containers of the first layer 41 with respect to those in the second layer 32.

Figure 4:
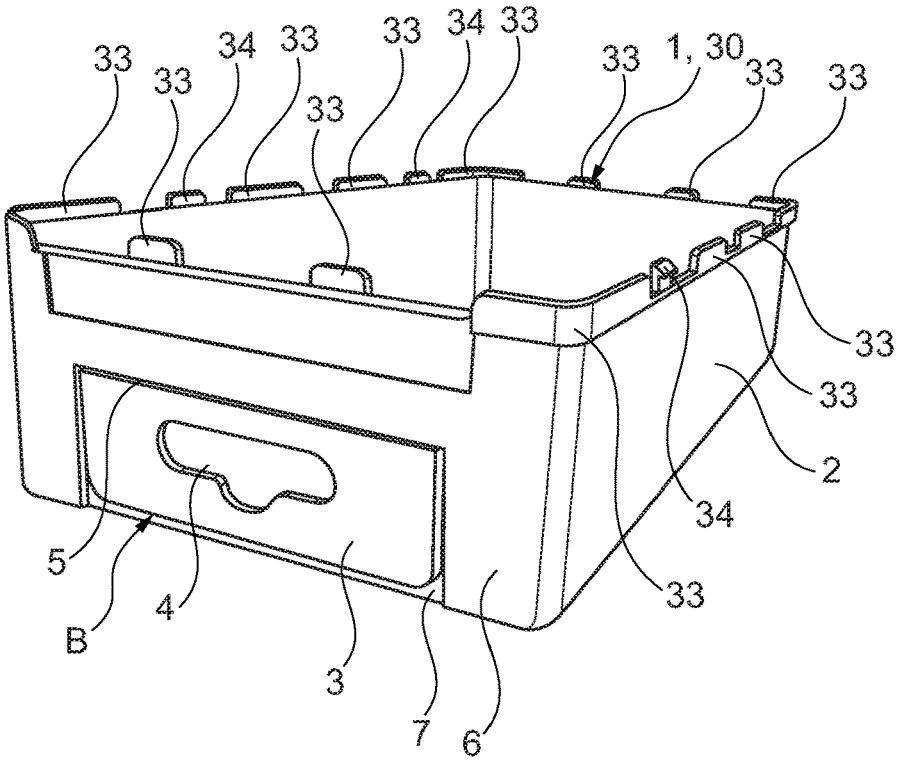
FIGS. 4, 5 show one possible embodiment of a storage container as it may, for example, be used together with the insert of FIG. 3 in the box of FIGS. 1 and 2, in various perspective representations.
Figure 5:
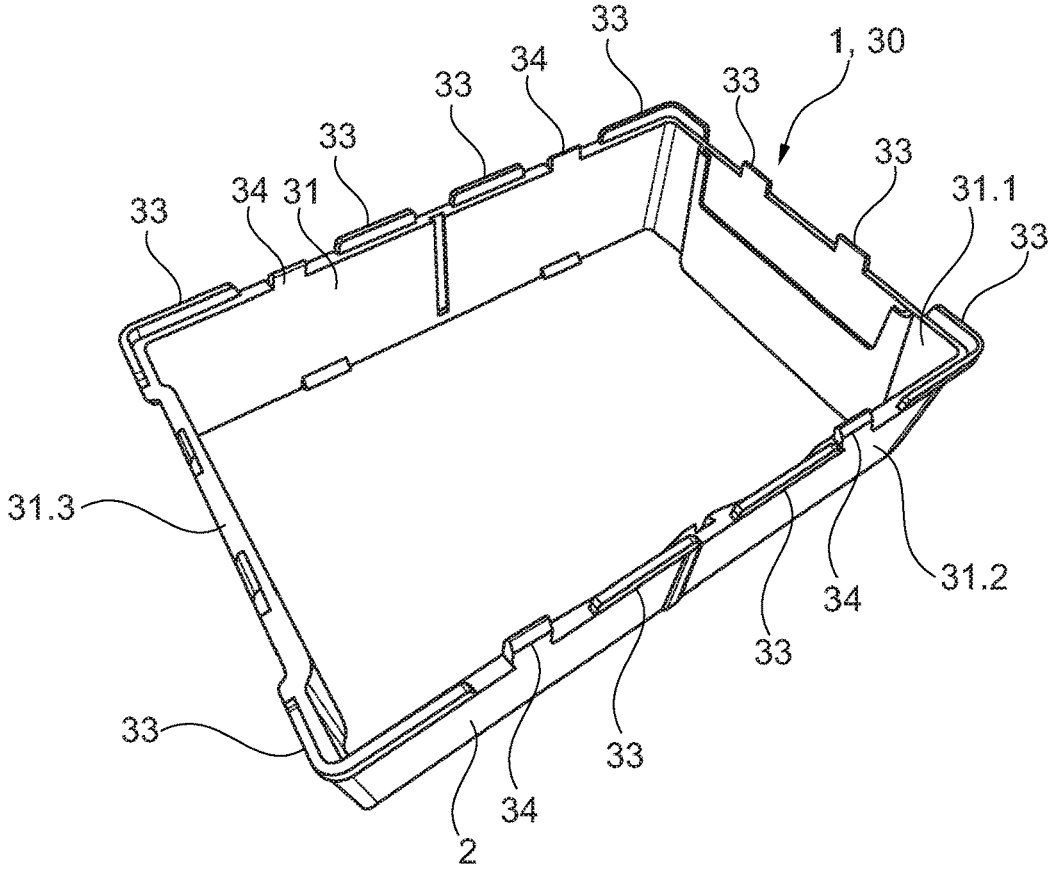
Figure 7:
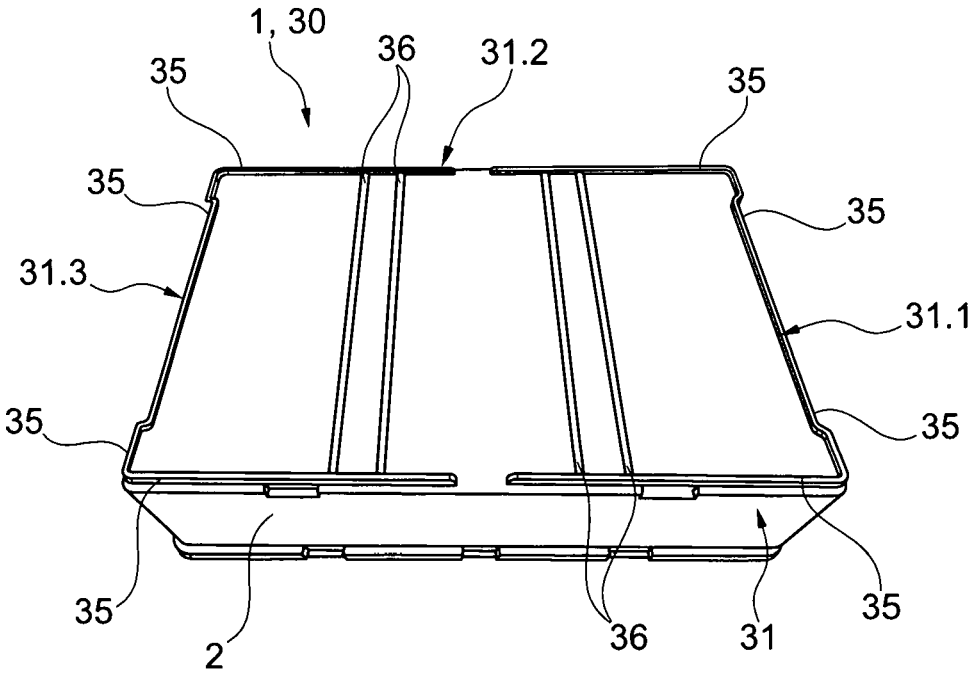
FIG. 7 shows the storage container of FIG. 4 in a view from the bottom.

The FIGS. 4, 5 and 7 depict in an exemplary manner the storage container 30 of the FIGS. 1 to 3 in different elevations. From this it is apparent that the container 30 is provided with a container 2 for storing small parts, tools, spare parts for tools, tool accessories, machines or other objects, wherein a material section 3 with a supporting element is provided in addition. The material section 3 is attached to the container with a connecting device 5.

The connecting device 5 is, for example, formed by a hinge, in particular a film hinge, through which the material section 3 may be pivoted from an initial position A into a storage position B, as is apparent from the example in FIGS. 3 and 4. In the initial position A the material section 3 extends outwards, away from container 2. In storage position B the material section 3 is folded away in the section of a wall 6 of container 2. The wall 6 is preferably provided with a recess, a pocket or such like in which the material section 3 is located in the storage position. This avoids the material section 3 from extending forward beyond the wall 6 in the storage position B.

The storage container 30 may be provided with at least one locking element (not apparent from the Figures), through which the material section 3 is retained in the storage position. Because of the presence of material section 3 the storage container 30 may be used as retail packaging 1.

The supporting element 4 makes it possible, for example, to attach the retail packaging 1 to a product display device. The supporting element 4 is, for example, formed as a Euro hole so that the retail packaging 1 may be suspended, for example, on a wall hook of a perforated wall for product presentation purposes.

Figure 6:
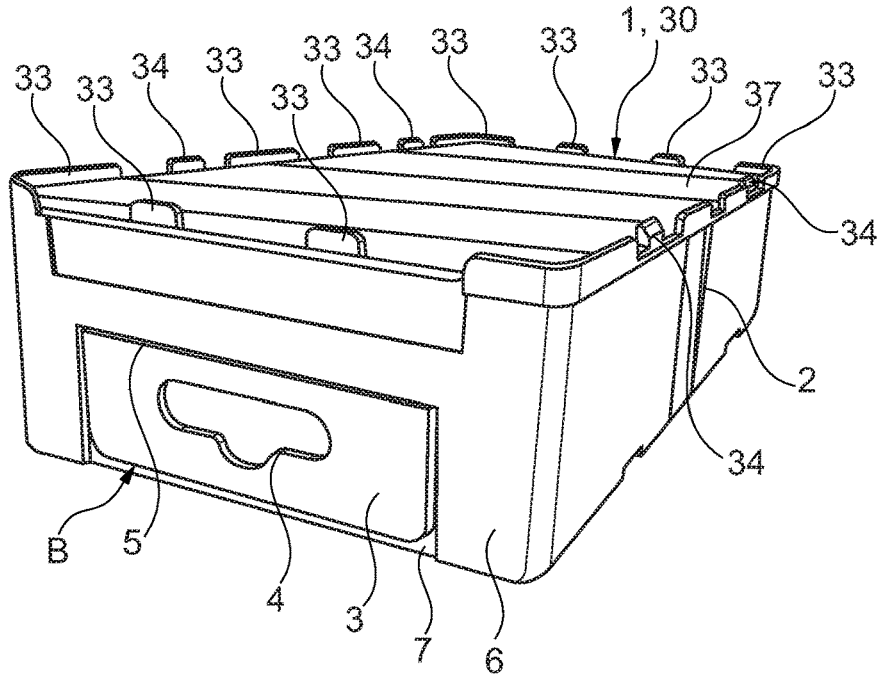
FIG. 6 shows the storage container of FIG. 4 together with a lid part in perspective view.

FIG. 6 depicts the storage container 30 with a lid part 37 (indicated by multiple transverse lines on the upper side), covering the container 2, which is open at the top. Preferred is at least one positive-locking element 34, such as a clip element for example, which is formed to the upper edge of container 2 and which locks the lid part 37 positively against the edge of the opening of container 2. It is preferable for container 2 to be provided, at least in sections, with an edge 33 that protrudes above the lid part 37, wherein said edge 33 acts as fence against a lateral displacement once a further storage container is stacked directly onto the storage container 30.

It is preferred that the further storage container is of the same design as the storage container 30. As is particularly apparent from FIG. 7, the storage container 30 is provided on the wall sections 31, 31.1, 31.2 with an edge 35 that protrudes downwards. Said edge 35 corresponds with the edge 33 that protrudes upwards so that the stacking of a storage container of the same design onto the storage container 30 is possible essentially without play, or without a significant amount of play. The downward-protruding edge 35 is preferably designed such that it grips against the protrusions 62 of the insert 60. It is also possible to provide reinforcing ribs 36.

Figure 8:
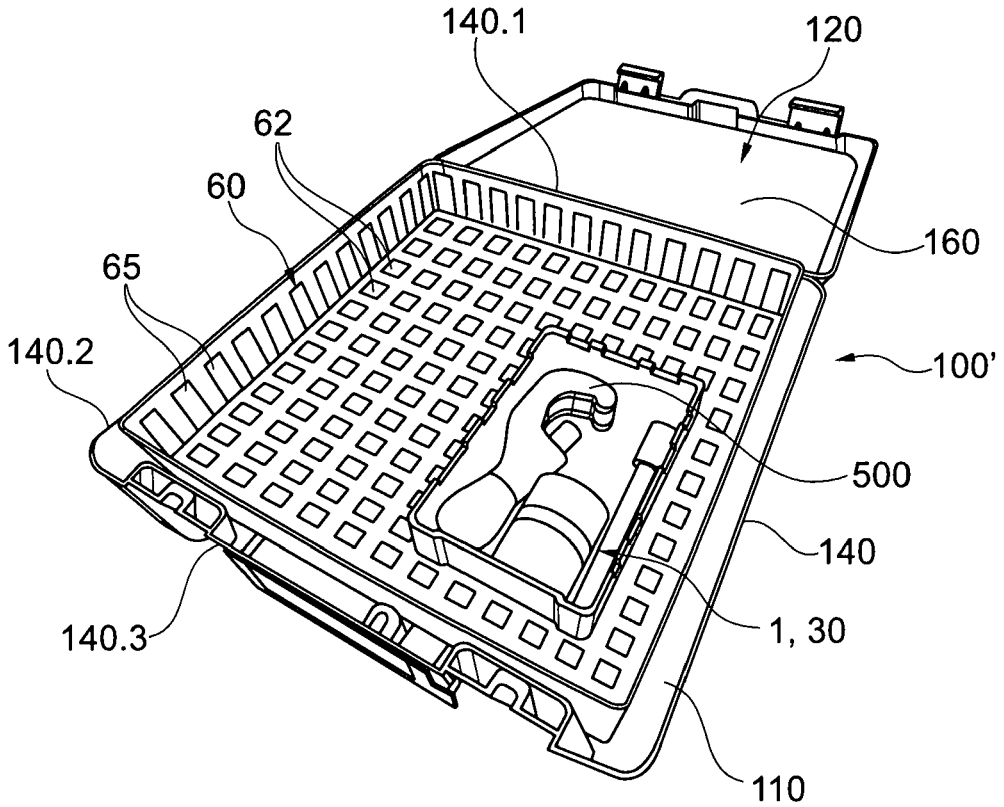
FIG. 8 shows a further possible embodiment of a box for transporting and/or storing of small parts, tools, machines or other objects in perspective view.

FIG. 8 depicts a further embodiment of the box 100' for the transport and/or storage of small parts, tools, machines or other objects 500. The components or functional parts of box 100', which are identical or functionally the same as the components or functional parts of box 100 according to FIGS. 1 and 2 are provided with the same reference numbers; in this respect please refer to the description of box 100.

The box 100' according to FIG. 8 differs from the box 100 of FIGS. 1 and 2, amongst others, in that on the inside of lid 120 an elastic intermediary layer 160 is provided so that in the closed state of box 100' a compression force derived from the deformation of the intermediary layer applies pressure onto the first layer 41 and the second layer 32 with the storage containers 30, 30.1, 30.2 and 40, 40.1, 40.2, 40.3 if the box is in the closed state. The intermediary layer 160 is preferably provided in form of a mat and consists of or comprises a foam material, for example.

To achieve the compression force in the closed state, the receiving space 150 has an inside height clearance in the closed state, which essentially corresponds to the external height of the first layer 41 and the second layer 32 and in addition the thickness of the insert 60 and the thickness of the further insert 70 without consideration of the height of the protrusions 62 and 72, so that in the closed state the storage containers 30, 30.1, 30.2 and 40, 40.1, 40.2, 40.3 are secured against disengagement from the respective protrusions 62, 72 of the inserts 60, 70.

LIST OF REFERENCE NUMBERS

1 Retail packaging
2 Container
3 Material section
4 Supporting element
5 Connecting device
6 Wall
7 Pocket
30 Storage container
30.1 Storage container
30.2 Storage container
31 Wall section
31.1 Wall section
31.2 Wall section
31.3 Wall section
32 Second layer
33 Protruding edge
34 Clip element
35 Protruding edge
36 Reinforcement rib
37 Lid part
40 Storage container
40.1 Storage container
40.2 Storage container
40.3 Storage container
41 First layer
60 Insert
61 Front side
62 Protrusion
63 Space
64 Back side
65 Corrugation
66 Cut-out
67 Side wall
67.1 Side wall
67.2 Side wall
67.3 Side wall
70 Further insert
72 Protrusions
100 Box
100' Box
110 Body
120 Lid
130 Bottom
140 Side wall
140.1 Side wall
140.2 Side wall
140.3 Side wall
150 Receiving space
160 Intermediary layer
500 Object
A Initial position
B Storage position

The invention claimed is:

1. A box (100; 100') for transporting and/or storing small parts, tools, machines or other objects (500), the box (100; 100') comprising:

a body (110);

a lid (120); and a receiving space (150) formed by the body (110) and the lid (120), wherein the body (110) is provided with a bottom (130) and side walls (140, 140.1, 140.2, 140.3) that surround the bottom (130) and wherein the lid (120) is attached to the body (110), wherein at least one storage container (30) for small parts, tools, machines or other objects (500) is disposed in the receiving space (150), wherein the at least one storage container (30) comprises side wall sections (31, 31.1, 31.2) with an edge (33) that protrudes downwardly below a bottom of the at least one storage container (30), wherein the at least one storage container (30) comprises a further edge (33) that protrudes upwardly from the side wall sections (31, 31.1, 31.2) of the at least one storage container (30), wherein the receiving space (150) is provided with a surface area which faces with one side the storage container (30) and is provided with a grid formed by a plurality of protrusions (62), wherein the at least one storage container (30) is disposed on the surface area in a position such that the side wall sections (31, 31.1, 31.2, 31.3) engage at least two of the protrusions (62) at the edge (35) whereby the at least one storage container (30) is secured against lateral displacement, wherein the surface area is formed on an insert (60), which is inserted into the receiving space (150) and faces with a front side (61) the storage container (30), wherein the insert (60) is braced with its back side (64) against further storage containers (40, 40.1, 40.2, 40.3) which, whilst forming a first layer (41), are braced against the bottom (130) of the body (110) so that the at least one storage container (30) that is positioned on the insert (60) forms a second layer (32), wherein the storage container (30) and the further storage containers (40, 40.1, 40.2, 40.3) are open at their respective tops, and wherein the open tops are facing the lid when the storage container (30) is closed.

2. The box according to claim 1, wherein the insert (60) is provided with a dimension along a spatial axis that corresponds to an inside clearance between the side walls (140, 140.1, 140.2, 140.3) of the body (110) along the spatial axis so that the insert (60) is retained in the receiving space (150) of the body (110) at least in direction of the spatial axis without significant play.

3. The box according to claim 1, wherein the first layer (41) with the further storage containers (40, 40.1, 40.2, 40.3) has a dimension along a spatial axis that corresponds to an inside clearance between the side walls (140, 140.1, 140.2, 140.3) of the body (110) along the spatial axis so that the first layer (41) is retained in the receiving space (150) of the body (110) at least in direction of the spatial axis without significant play.

4. The box according to claim 1, wherein in a closed state of the box (100) the receiving space (150) has an inside height clearance that essentially corresponds to an external height of the first layer (41) together with the further storage containers (40, 40.1, 40.2, 40.3) and the second layer (32) with the at least one storage container (30) and in addition to it the thickness of the insert (60) without consideration of the height of the protrusions (62), so that in the closed state the at least one storage container (30) is secured against disengagement from the protrusions (62) of the insert (60).

5. The box according to claim 1, wherein an elastic intermediary layer (160) is provided on an inside of the lid (120) so that in a closed state of the box (100') a compression force derived from deformation of the intermediary layer (160) acts upon the at least one storage container (30).

6. The box according to claim 1, wherein the at least one storage container (30) is provided on one side with an at least partially upwards protruding edge (33) for accurately stacking a further storage container.

7. The box according to claim 1, wherein the at least one storage container (30) serves as a retail packaging (1) for small parts, tools, machines or other objects (500), wherein the retail packaging (1) is an inherently stable container (2) for holding an object (500) and comprises a material section (3) with a supporting element (4), wherein said material section (3) extends, in an initial position (A), outwards and away from the inherently stable container (2) so that the supporting element (4) is usable for attaching the retail packaging (1) to a product display device, and wherein the retail packaging (1) comprises a connecting device (5) that connects the material section (3) and the inherently stable container (2) to one another.

8. The box according to claim 7, wherein the connecting device (5) is provided in form of a hinge through which the material section (3) is pivoted, with respect to the inherently stable container (2), from the initial position (A) into a storage position (B), in which the material section (3) is folded towards a wall (6) of the inherently stable container (2).

9. The box according to claim 8, wherein the retail packaging (1) includes plastic and wherein the hinge is a film hinge.

10. The box according to claim 8, wherein the retail packaging (1) comprises at least one locking element through which the material section (3) may be locked in the storage position (B) against inherently stable container (2).

11. The box according to claim 7, wherein the connecting device (5) is provided with at least one predetermined breaking point at which the material section (3) can be separated from the inherently stable container (2) under application of a separating force.

12. The box according to claim 1, wherein the insert (60) comprises insert side walls (67, 67.1, 67.2, 67.3).

13. The box according to claim 12, wherein two opposite of the insert side walls include a cut-out forming a handhold.

14. The box according to claim 13, wherein the handhold is arranged above the body.

15. The box according to claim 1, wherein the insert (60) is tub-shaped.

16. The box according to claim 1, wherein an elastic intermediary layer (160) is provided on an inside of the lid (120), and wherein the elastic intermediary layer (160), in a closed state of the box, applies a compression forces onto the first layer (41) and the second layer (32) of storage containers.

17. The box according to claim 1, wherein the body is deeper than the lid.

18. A box (100; 100') for transporting and/or storing small parts, tools, machines or other objects (500), the box (100; 100') comprising:

a body (110);

a lid (120); and a receiving space (150) formed by the body (110) and the lid (120), wherein the body (110) is provided with a bottom (130) and side walls (140, 140.1, 140.2, 140.3) that surround the bottom (130) and wherein the lid (120) is attached to the body (110), wherein at least one storage container (30) for small parts, tools, machines or other objects (500) is disposed in the receiving space (150), wherein the at least one storage container (30) comprises side wall sections (31, 31.1, 31.2) with an edge (33) that protrudes downwardly below a bottom of the at least one storage container (30), wherein the at least one storage container (30) comprises a further edge (33) that protrudes upwardly from the side wall sections (31, 31.1, 31.2) of the at least one storage container (30), wherein the receiving space (150) is provided with a surface area which faces with one side the storage container (30) and is provided with a grid formed by a plurality of protrusions (62), wherein the at least one storage container (30) is disposed on the surface area in a position such that the side wall sections (31, 31.1, 31.2, 31.3) engage at least two of the protrusions (62) at the edge (35) whereby the at least one storage container (30) is secured against lateral displacement, wherein the surface area is formed on an insert (60), which is inserted into the receiving space (150) and faces with a front side (61) the storage container (30), wherein the insert (60) is braced with its back side (64) against further storage containers (40, 40.1, 40.2, 40.3) which, whilst forming a first layer (41), are braced against a further insert (70) that is provided with grid-like arranged protrusions (72) so that the at least one storage container (30) that is positioned on the insert (60) forms a second layer (32), wherein the further storage containers (40, 40.1, 40.2, 40.3) each comprise side wall sections with an edge that protrudes downwardly below a bottom of each of the further storage containers, wherein each of the further storage containers storage containers is disposed on the further insert (70) in a position such that the side wall sections of the further storage containers engage at least two of the protrusions at the edge whereby the further storage containers are secured against lateral displacement, wherein the storage container (30) and the further storage containers (40, 40.1, 40.2, 40.3) are open at their respective tops, and wherein the open tops are facing the lid when the storage container (30) is closed.

19. The box according to claim 18, wherein the further insert (70) has a dimension along a spatial axis that corresponds to an inside clearance between the side walls (140, 140.1, 140.2, 140.3) of the body (110) along the spatial axis so that the further insert (70) is disposed in the receiving space (150) of the body (110) at least in direction of the spatial axis without significant play.

20. The box according to claim 18, wherein in a closed state of the box (100) the receiving space (150) has an inside height clearance that essentially corresponds to an external height of the first layer (41) together with the further storage containers (40, 40.1, 40.2, 40.3) and the second layer (32) with the at least one storage container (30) and in addition to it the thickness of the insert (70) without consideration of the height of the protrusions (62, 72), so that in the closed state the at least one storage container (30) and the further storage containers (40, 40.1, 40.2, 40.3) are secured against disengagement from the protrusions (62, 72) of the inserts (60, 70).

* * * * *